US008758079B2

(12) United States Patent
Arnau Manresa

(10) Patent No.: US 8,758,079 B2
(45) Date of Patent: Jun. 24, 2014

(54) TOY MOTORCYCLE FOR TRACKS WITH GUIDING GROOVE

(75) Inventor: Lluis Maria Arnau Manresa, Barcelona (ES)

(73) Assignee: Winkler International, S.A., Luxembourg (LU)

( * ) Notice: Subject to any disclaimer, the term of this patent is extended or adjusted under 35 U.S.C. 154(b) by 350 days.

(21) Appl. No.: 13/129,466

(22) PCT Filed: Nov. 18, 2008

(86) PCT No.: PCT/ES2008/070207

§ 371 (c)(1), (2), (4) Date: May 16, 2011

(87) PCT Pub. No.: WO2010/058040

PCT Pub. Date: May 27, 2010

(65) Prior Publication Data

US 2011/0230118 A1 Sep. 22, 2011

(51) Int. Cl.
*A63H 18/00* (2006.01)

(52) U.S. Cl.
USPC ..... 446/446; 446/440; 446/444

(58) Field of Classification Search
USPC ..... 446/440, 444, 445, 446
See application file for complete search history.

(56) References Cited

U.S. PATENT DOCUMENTS

| | | | | |
|---|---|---|---|---|
| 3,785,086 A | | 1/1974 | Escobedo | |
| 4,290,228 A | * | 9/1981 | Goldfarb et al. | 446/288 |
| 6,095,891 A | * | 8/2000 | Hoeting et al. | 446/440 |
| 6,095,892 A | * | 8/2000 | Moe | 446/440 |
| 6,524,158 B1 | * | 2/2003 | Fong | 446/330 |
| 6,626,116 B2 | * | 9/2003 | Clark, Jr. et al. | 104/60 |
| 7,601,068 B1 | * | 10/2009 | McGee | 463/58 |
| 2011/0151747 A1 | * | 6/2011 | Berenguer et al. | 446/440 |

FOREIGN PATENT DOCUMENTS

| | | |
|---|---|---|
| ES | 1026976 | 6/1994 |
| ES | 2067384 | 3/1995 |
| ES | 2303494 | 8/2008 |
| FR | 2486809 | 1/1982 |
| JP | 2008011997 | 1/2008 |

OTHER PUBLICATIONS

International Search Report for PCT/ES2008/070207 dated Apr. 9, 2009.

* cited by examiner

*Primary Examiner* — Gene Kim
*Assistant Examiner* — Joseph B Baldori
(74) *Attorney, Agent, or Firm* — Nixon & Vanderhye P.C.

(57) ABSTRACT

A toy motorcycle for use on a track with a guide groove includes an electric motor, a chassis, and a support structure mounted on the bottom of the chassis that includes at least two support wheels and a magnet. A guide mounted on the support structure is configured to engage the guide groove of a track. A frame is associated with the chassis, and a rear traction wheel and a front wheel are mounted on the frame. The rear traction wheel is operatively coupled to the electric motor. The toy motorcycle includes a tilting system that tilts the frame when the toy motorcycle is traversing a curved section of a track. The tilting system also causes the rear wheel to traverse a different curve trajectory than the guide groove of the track.

8 Claims, 4 Drawing Sheets

TOY MOTORCYCLE FOR TRACKS WITH GUIDING GROOVE

This application is the U.S. National Phase of International Application No. PCT/ES2008/070207 filed 18 Nov. 2008 which designated the U.S., the entire contents of which is hereby incorporated herein by reference.

Toy motorcycle for tracks with guiding groove of the type comprising an electric motor, a motorcycle chassis, a guide, arranged inside the guiding groove of a track, joined to a structure, located at the bottom of the motorcycle, with at least two support wheels and a magnet, which comprises a frame connected to the chassis, a rear traction wheel, upon which the electric motor acts, integral with the frame, and a tilting system for tilting the frame along the track curve, with respect to the structure, moving a rear wheel, with said wheel defining a curve trajectory different to the curve trajectory of the guide.

BACKGROUND TO THE INVENTION

Spanish Patent No. 9300204 (ES2067384) "Motorcycle for electric tracks" from 1993 in the name of Mr. Carlos Jesús DE PABLOS BAEZA is known in the prior art, which relates to a motorcycle for electric tracks, having the particular feature of the link between its chassis and the carriage-guide on which it moves around the track, being made by tilting on both sides, due to the existence of one or two tie-rods hinged at one or two parts, producing a pendulum effect in the transverse direction, with the singularity that both the front and rear wheel can, optionally, be provided with suspension, in the first case by means of a yoke dampened by an elastic strip with its course limited by a screw, and in the second case, due to the fact that the trapezium moves along a rod fixed to the chassis, which is pressed underneath by a spring, there being no suspensions in the event that a tie-rod is used.

Also Spanish Utility Model No. 9400257 (ES1026976) from 1994, is known, in the name of Mr. Juan Manuel GÓMEZ SALCEDO, which relates to a motor vehicle support with an incorporated motorcycle provided with all types of movement, applicable to electric tracks, characterised in that it is shaped from a base plate, made from an appropriate material, which adopts a noticeably elongated shape, provided with side wings in the middle rear area, where wheels are coupled to stabilise the unit, in which base plate on the inner face thereof a strip of appropriate length is hinged, which is flat and has a rotation axis at is rear end, which coincides with the middle rear area of the base plate, said strip having hinged at its front end, a guide piece that fits between the rails of the electric track in question, while the middle rear area has a vertical axis that crosses the base plate through an arched groove, which has an axis at its top end with a yoke in which there fits an integral bolt of a connecting rod arranged parallel to said axis and hinged with the ability to rotate at its lower end on the top plate superimposed on the base plate, which converts the tilting movement of the connecting rod to the side on which the curve is produced followed by the previous guide.

The closest document found is Spanish Patent No. 200800276 (ES2303494) "Slot Motorcycle" from 2008, in the name of the Spanish company BYCMO RC MODELS, S.L., relating to a slot motorcycle that has a guide carriage provided with stabilising side extensions, provided at the ends thereof with support means. It has a servomotor integral with the chassis and the wheels, with a horizontal rotation axis, essentially longitudinal to the direction of movement of the motorcycle, its output shaft comprising at the front end thereof a first rack that moves along a vertical guide that is integral with the carriage-guide. This way the motorcycle can tilt towards the inside of a traced curve, thanks to the fact that, from the motorcycle's vertical position, rotating the servomotor produces a downward movement of the first rack and tilts the top part of the chassis-wheel unit.

BRIEF DESCRIPTION OF THE INVENTION

This invention is an improvement in the sector of motorcycles for slot tracks.

As can be verified by the background to the invention, the inventions try to solve the problem of how to simulate the effect of the motorcycle tilting in very different ways.

There are inventions (U9400257) (ES1026976) based on the tilting of the motorcycle, with the wheels being on the actual guiding groove, in other words, the wheels do not move. This type of invention suffers from the drawback that it is not very realistic, because in fact, the motorcycle does not really follow that trajectory.

Others (P9300204) (ES2067384) consider using strips to allow the pilot to tilt and recover his position. Even though the movement is more realistic, visually it does look very real.

Lastly, a third group (P200800276) (ES2303494) consider that it is the user/player who decides when to make the pilot hang from the motorcycle.

The inventor, with the idea of making it as realistic as possible, has developed a mechanism which, when the motorcycle reaches a curve, allows it to tilt gradually as the curve becomes more pronounced, and as the curve opens up, it recovers its vertical position.

So, the inventor avails of the centrifugal force produced as the motorcycle rotates in the curve, which sends said motorcycle outwards, so that the wheels come out of the trajectory of the guiding groove, skidding, in turn tilting the motorcycle via the action of the force of gravity that compensates the centrifugal force.

Continuing the trajectory and facing the next straight section, the centrifugal force on the motorcycle reduces and the motorcycle recovers its initial position owing to the compensation of forces between the centrifugal force and gravitational force.

An object of this invention is a toy motorcycle for tracks with a guiding groove of the type comprising an electric motor, a motorcycle chassis, a guide, arranged inside a guiding groove of a track, joint to a structure, located in the bottom part of the motorcycle, with at least two support wheels and a magnet, characterised in that it has a frame associated with the chassis, a rear traction wheel, on which the electric motor acts, which is integral with the frame, and a tilting system for tilting the frame along the track curve, with respect to the structure, moving a rear wheel, with said wheel defining a curve trajectory that is different to the curve trajectory of the guide.

BRIEF DESCRIPTION OF THE DRAWINGS

In order to facilitate the explanation four sheets of drawings are attached to this invention, which represent a practical embodiment, which is provided as a non-limiting example of the scope of this invention.

PARTICULAR EMBODIMENT OF THE INVENTION

Figure 1:
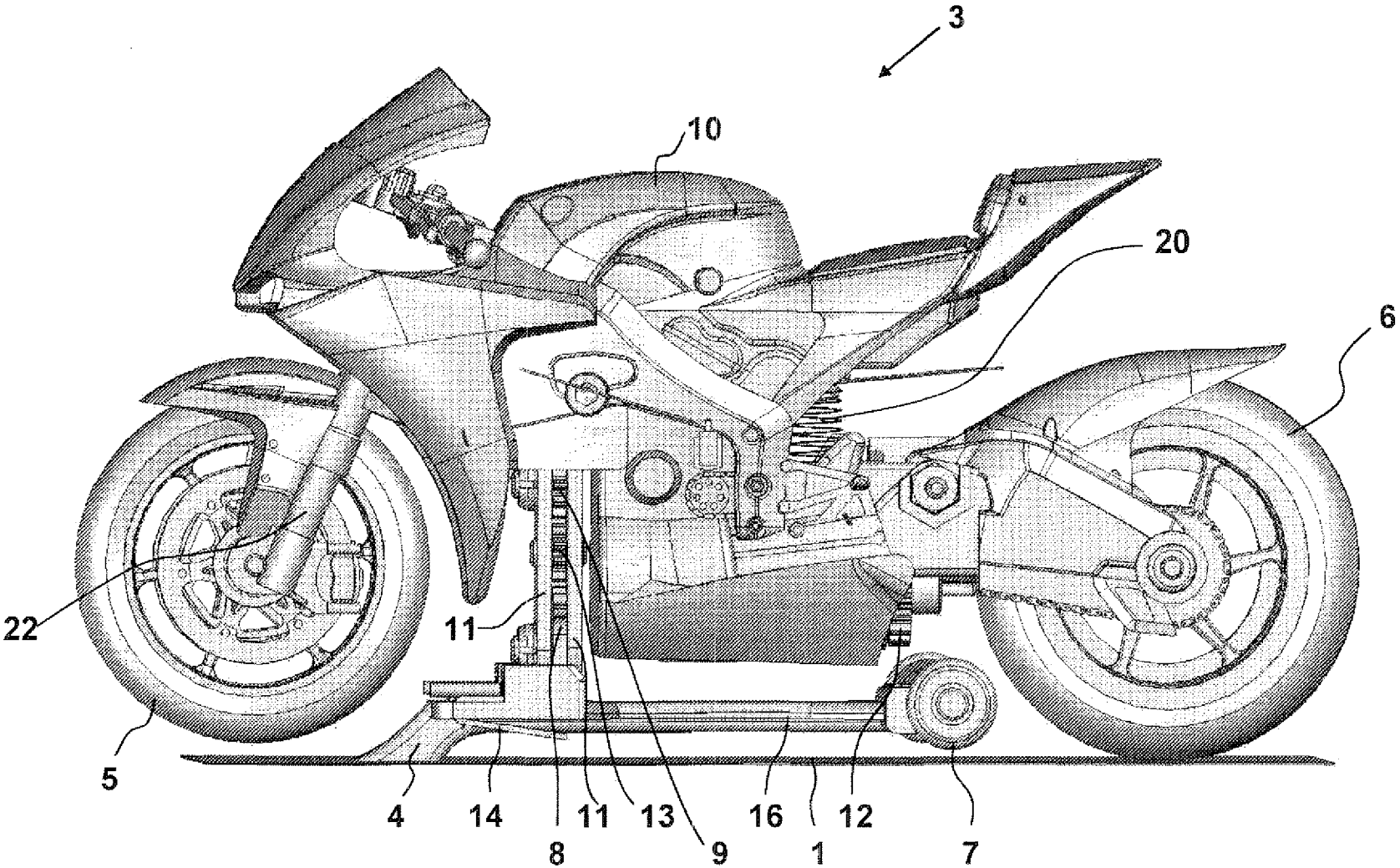
FIG. 1 is a side view of the aim of this invention.

So FIG. 1 shows a track 1, a motorcycle 3, with its chassis 10, a front wheel 5, a rear wheel 6, an electric motor 12, a structure 16, support wheels 7, a guide 4, braids 14, strips 11 which confine a first rack 8, a toothed wheel 13 and a second rack 9, a yoke 22 and a spring 20.

Figure 2:
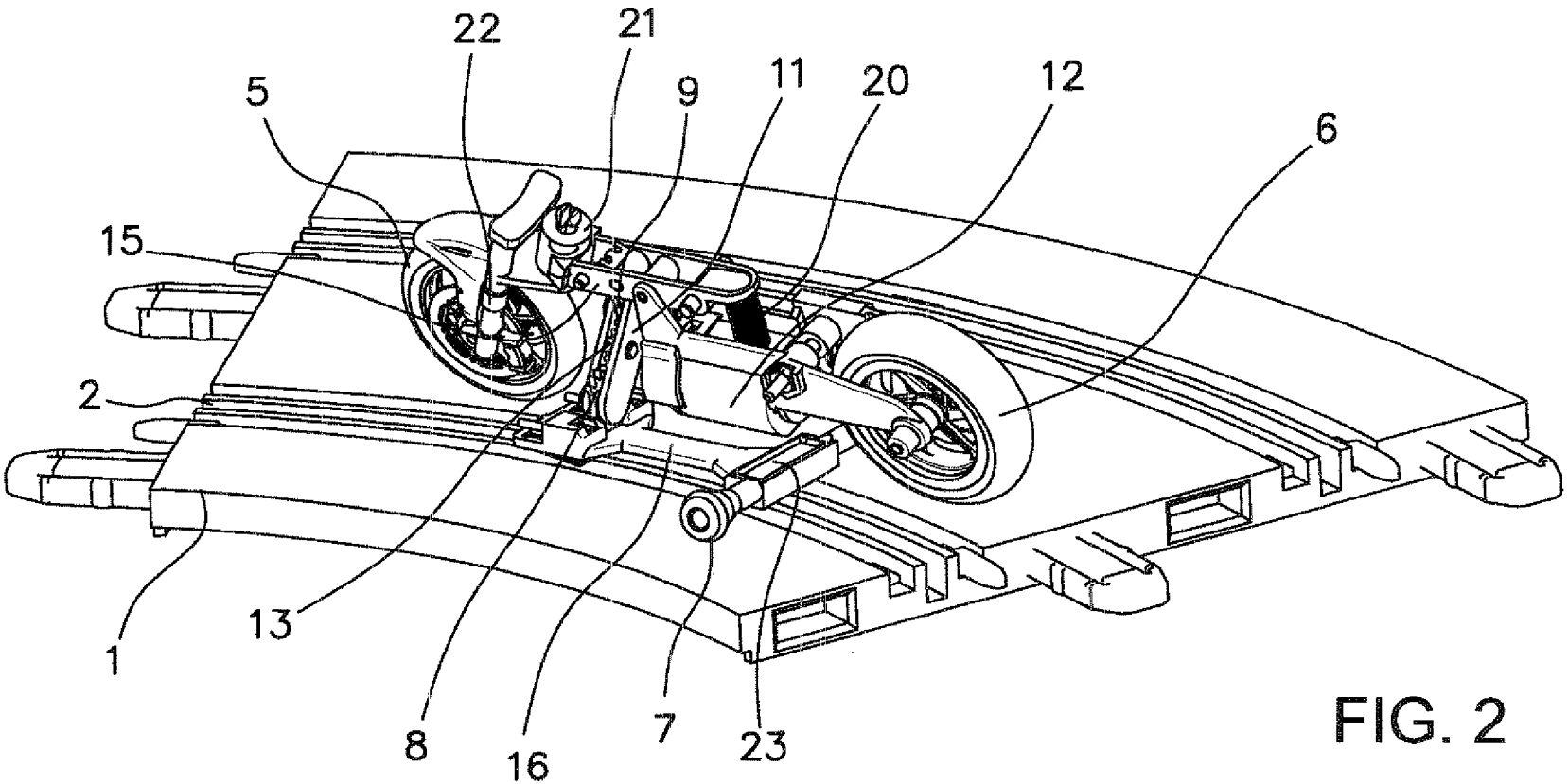
FIG. 2 is an elevate left side view from behind of the motorcycle, in a curve and without the chassis.

FIG. 2 shows track 1, with the guiding groove 2, front wheel 5 and rear wheel 6, electric motor 12, a steering rotor 21, a yoke 22, structure 16, support wheels 7, a magnet 23, strips 11 with first rack 8, second rack 9, toothed wheel 13 and a frame 15 with spring 20.

Figure 3:
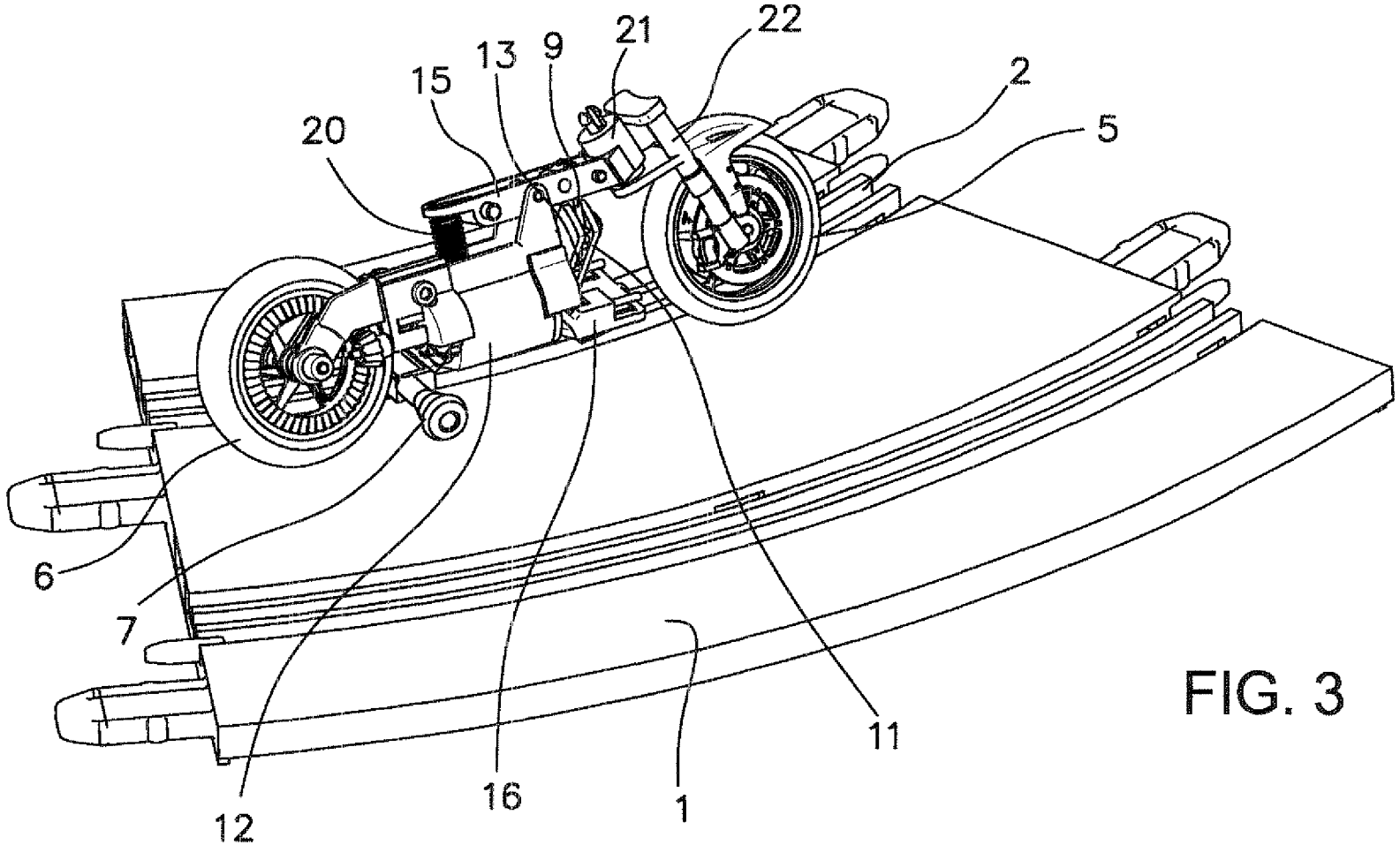
FIG. 3 is a view of a right side view of the motorcycle.

FIG. 3 shows said track 1, with guiding groove 2, front wheel 5 and rear wheel 6, structure 16, support wheels 7, strips 11 with second rack 9, toothed wheel 13, electric motor 12, steering rotor 21, yoke 22 and frame 15 with spring 20.

Figure 4:
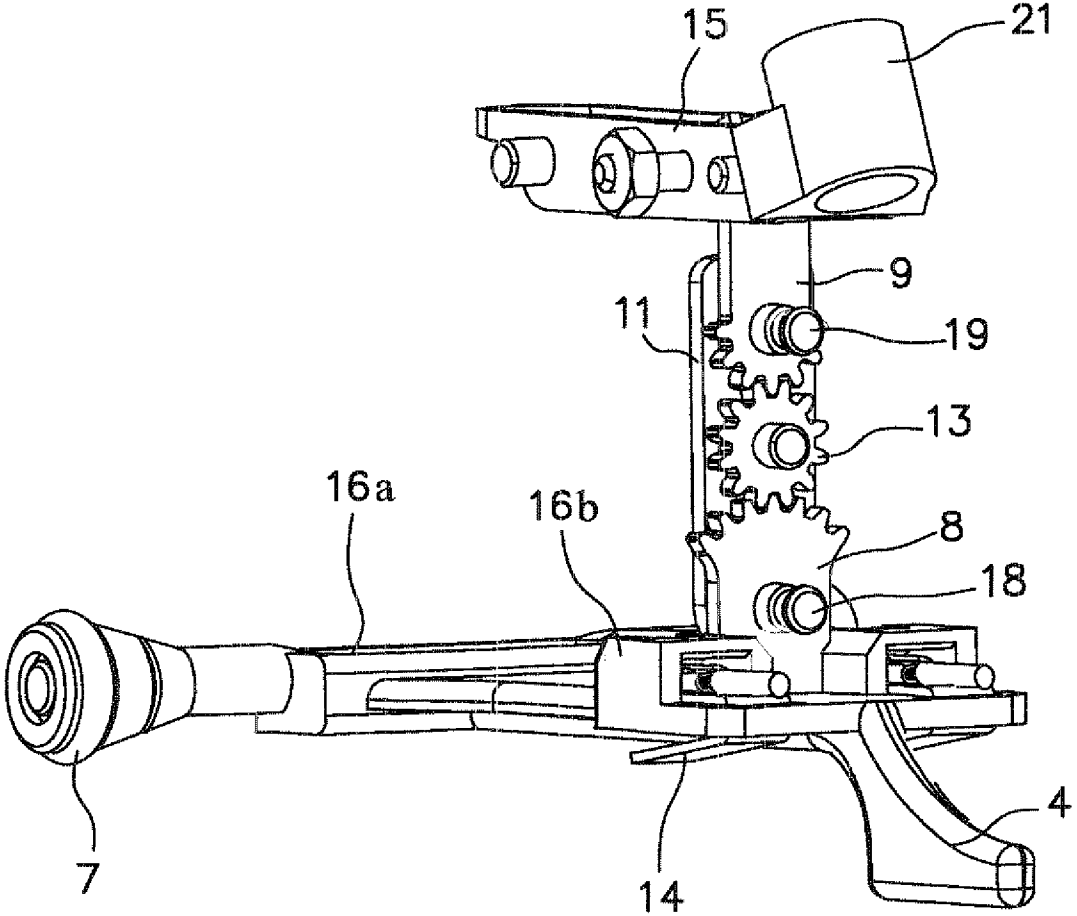
FIG. 4 is a detailed view of the central part of the motorcycle.

Lastly, FIG. 4 shows guide 4, braids 14, the structure divided into two parts 16*a* and 16*b*, support wheels 7, steering rotor 21, strip 11, first rack 8 with first rotation axis 18, second rack 9 with second rotation axis 19, toothed wheel 13 and frame 15.

This way, in a particular embodiment, motorcycle 3 is arranged on track 1 (FIG. 1) introducing the guide 4 into guiding groove 2 (see FIGS. 2 and 3). So, braids 14 come into contact with guiding groove 2 and the electric current supplies electric motor 12 of motorcycle 3, which acts upon rear wheel 6.

In FIG. 1, in the interest of clarity, a simulation has been produced wherein motorcycle 3 has been raised at the front part thereof to provide a better view of braids 14, support wheels 7 and guide 4. Therefore, neither support wheels 7 nor braids 14 are, in this view, in contact with track 1 or guiding groove 4.

Essentially, the toy motorcycle for tracks with a guiding groove comprises electric motor 12, chassis 10 of motorcycle 3, guide 4, arranged inside a guiding groove 2 of track 1, joined to a structure 16, located at the bottom of motorcycle 3, with at least two support wheels 7 and a magnet 23.

It also comprises frame 15 associated to chassis 10, rear traction wheel 6, on which electric motor 12 acts, integral with frame 15, and a tilting system for tilting frame 15 along the curve of track 1, with respect to structure 16, moving rear wheel 6, with said rear wheel 6 defining a curve trajectory that is different to the curve trajectory of guide 4 (see FIGS. 2 and 3).

In this embodiment it has been chosen that the tilting system be a system of racks, although others could be considered, such as for example, a cam-based system.

Upon reaching the curve (see FIGS. 2 and 3), as a result of the centrifugal force motorcycle 3 tends to come out of guiding groove 2.

This way, owing to the action of said centrifugal force chassis 10 tilts, as gravity balances said centrifugal force and positions the wheels outside the trajectory of guiding groove 2, imitating the action of competition motorcycles in speed races.

This tilting movement is achieved via a first rack 8, integral to guide 4. When the curve begins second rack 9 is moved and moves toothed wheel 13 which moves on first rack 8, whereby chassis 3, which is integral to frame 15 that is joined to second rack 9 also tilts and simulates the same tilting effect of top competition motorcycles. Even so, it is important to take into account the function of strips 11, as will be detailed below, which will show that the movement is produced by the rotation of second rack 9 on toothed wheel 13, which respectively rotates first rack 8.

To maintain adherence, support wheels 7 that are integral to structure 16 maintain the same trajectory as guide 4 and always remain adhered to track 1. This is also determined by the existence of magnet 23, located at the bottom of structure 16, which increases the adherence of structure 16 to track 1.

Once motorcycle 3 recovers its straight trajectory, the centrifugal force tends to disappear and so motorcycle 3 recovers its vertical position via the action of gravity which in compensating the centrifugal force returns motorcycle 3 to its more stable position.

In other words, toothed wheel 13 would rotate in the opposite direction on first 8 and second 9 racks, leaving said racks 8, 9 and toothed wheel 13 perpendiculars to track 1.

Strips 11 have a double function. On the one hand they support said racks 8, 9 and toothed wheel 13, and on the other hand, they allow the above-mentioned tilting action of motorcycle 3.

Said tilting movement is maintained when the first rotation axis 18 allows strips 11 to rotate from a fixed point, such as the first rack 8, producing the tilting movement, and at the same time second rack 9 can rotation according to the tilting angle of strips 11, and therewith toothed wheel 13, When second rack 9 rotates in turn frame 15 tilts which does the same to the motorcycle chassis 10.

FIG. 4 shows in detail mainly racks 8, 9, their link to structure 16 and frame 15 respectively and their relation with guide 4.

To increase the motorcycle's adherence to track 1 and facilitate recovery, if steering rotor 21 is extended imaginarily towards track 1, the point of intersection between both is the point at which front wheel 5 comes into contact with track 1, and not as would be logical, the extension of yoke 22. In other words, the extension axis of steering rotor 21 is different from that of yoke 22.

Thanks to the rotation geometry of yoke 22 since the extension axis of rotor 21 and of yoke 22 are offset it is possible to improve the fact that when the motorcycle 3 is in a vertical position front wheel 5 tends to separate the trajectory of the motorcycle towards either side.

When the centrifugal force acts, front wheel 5 helps the motorcycle unit to move outside of the trajectory of guide 4.

Once motorcycle 3 is tilted, the function of front wheel 5 changes completely, since when tilted the point of support of front wheel 5 on track 1 varies with respect to the rotation axis of the steering yoke 22. So, front wheel 5 tends to help centre motorcycle 3 towards said guiding groove 2.

So when there is no more centrifugal force, motorcycle 3 returns to its vertical position more quickly.

The result is that we have a motorcycle 3 that is permanently unstable. So with this rotation geometry, when the centrifugal force acts, it quickly moves towards the outside of the curve and vice versa.

As can be seen, structure 16 can, for manufacturing reasons, be made in one or several parts, and in this embodiment it is in two parts 16*a* and 16*b*, which are joined to form a whole.

As can be seen in FIG. 1 it is envisaged to provide a spring 20, between frame 15 and electric motor 12, to give the motorcycle 3 greater stability in the curves. In principle front wheel 5 tends to open up or move outwards, which is partially compensated by said spring 20.

To summarise, with this tilting system based on tilting frame 15, the motorcycle is not free, instead it follows the path defined by guide 4 without any problems.

This patent of invention describes a new toy motorcycle for tracks with a guiding groove. The examples mentioned herein have a non-limiting effect on this invention, and therefore this invention can have different applications and/or adaptation, all within the scope of the following claims.

The invention claimed is:

1. A toy motorcycle for use on a track with a guide groove, comprising:

an electric motor;

a chassis;

a support structure located at a bottom of the chassis that includes at least two support wheels and a magnet;

a guide configured to engage a guide groove of a track, the guide being joined to the support structure;

a frame associated with the chassis;

a rear traction wheel mounted on the frame and operatively coupled to the electric motor; and a tilting system that tilts the frame and the rear traction wheel relative to the support structure as the motorcycle moves along curved portions of a track such that the rear traction wheel traces a trajectory around curved portions of the track that is different from a trajectory of the guide groove in the track, the tilting system comprising:

a first rack that is integral with the guide, at least one toothed wheel that meshes with the first rack, a second rack that also meshes with the toothed wheel and which is integral with the frame, a pair of strips that confine the first and second racks and the toothed wheel, a first rotational axis located on the first rack, and a second rotational axis located on the second rack, wherein when the toy motorcycle traverses a curved section of a track, centripetal forces acting on the frame cause the at least one toothed wheel to move with respect to the first rack, and thereby rotate, and wherein rotation of the at least one toothed wheel causes the second rack and the frame to rotate around the second rotational axis of the second rack.

2. The toy motorcycle according to claim 1, further comprising:

a steering rotor and a yoke that rotates about an axis of rotation of the steering rotor, and a front wheel mounted on the yoke, wherein the steering rotor and the yoke are configured such that the axis of rotation of the steering rotor and the longitudinal axis of the yoke cross one another at approximately the point where the front wheel contacts the track.

3. The toy motorcycle of claim 2, wherein when the front and rear traction wheels are outside the trajectory of the guide groove of a track, the chassis is tilted with respect to the upper surface of the track, and the front and rear traction wheels are in contact with the upper surface of the track.

4. The toy motorcycle according to claim 3, further comprising a spring mounted between the frame and the electric motor.

5. The toy motorcycle according to claim 1, wherein the support structure comprises at least two parts that are joined together.

6. The toy motorcycle according to claim 1, wherein the support structure includes an arm having a longitudinal axis that extends approximately perpendicular to a longitudinal axis of the frame, and wherein the at least two support wheels comprise first and second wheels located at first and second ends of the arm.

7. The toy motorcycle of claim 1, wherein centripetal forces acting on the frame cause the at least one toothed wheel to rotate around the first rotational axis of the first rack.

8. The toy motorcycle according to claim 4, wherein the spring biases the electric motor and the rear traction wheel downward with respect to the frame.

* * * * *